US010204601B2

(12) United States Patent
Dain

(10) Patent No.: US 10,204,601 B2
(45) Date of Patent: Feb. 12, 2019

(54) SOUNDBOARD APPARATUS AND METHOD OF FORMING

(71) Applicant: Hurstwood Farm Piano Studios Ltd., Sevenoaks Kent (GB)

(72) Inventor: Richard Dain, Sevenoaks Kent (GB)

(73) Assignee: Hurstwood Farm Piano Studios Ltd. (GB)

( * ) Notice: Subject to any disclaimer, the term of this patent is extended or adjusted under 35 U.S.C. 154(b) by 0 days.

(21) Appl. No.: 15/511,775

(22) PCT Filed: Mar. 27, 2015

(86) PCT No.: PCT/GB2015/050950
§ 371 (c)(1),
(2) Date: Mar. 16, 2017

(87) PCT Pub. No.: WO2016/001616
PCT Pub. Date: Jan. 7, 2016

(65) Prior Publication Data

US 2017/0301320 A1 Oct. 19, 2017

(30) Foreign Application Priority Data

Jun. 30, 2014 (GB) ..... 1411613.1

(51) Int. Cl.
*G10C 3/06* (2006.01)
*G10D 1/00* (2006.01)

(52) U.S. Cl.
CPC ..... *G10C 3/06* (2013.01); *G10D 1/005* (2013.01)

(58) Field of Classification Search
CPC ... G10C 3/00; G10C 1/00; G10C 1/02; G10C 1/04
See application file for complete search history.

(56) References Cited

U.S. PATENT DOCUMENTS

| | | | | |
|---|---|---|---|---|
| 4,348,933 | A | 9/1982 | Kaman | |
| 2015/0135930 | A1* | 5/2015 | Luttwak | G10D 3/04 84/307 |

FOREIGN PATENT DOCUMENTS

| | | | |
|---|---|---|---|
| CN | 201946282 | U | 8/2011 |
| FR | 2598843 | A1 | 11/1987 |
| GB | 1329817 | A | 9/1973 |
| WO | 2010086690 | A2 | 8/2010 |
| WO | 2013158602 | A1 | 10/2013 |

* cited by examiner

*Primary Examiner* — Kimberly Lockett
(74) *Attorney, Agent, or Firm* — Laubscher & Laubscher, P.C.

(57) ABSTRACT

The present invention concerns soundboard apparatus for a musical instrument, the apparatus comprising a soundboard substrate formed of composite fibrous resin bonded material having a thickness of between 0.75 mm and 3 mm; and an outer layer formed of ultra-violet light blocking material having a thickness of between 0.5 and 0.9 mm. Further, the present invention relates to a method of forming a soundboard apparatus, the method comprising the steps of: bonding multiple layers of woven or straight stranded fibrous material in a resinous matrix to form a soundboard substrate, wherein the soundboard substrate is formed such that it is oversized with respect to final soundboard substrate dimensions; and finishing the soundboard substrate to form the final substrate, the finishing process being constrained to ensure that the final substrate dimensions are not compromised.

18 Claims, 2 Drawing Sheets

SOUNDBOARD APPARATUS AND METHOD OF FORMING

CROSS-REFERENCE TO RELATED APPLICATIONS

This application is a § 371 National Stage Entry of PCT International Application No. PCT/GB2015/050950 filed on Mar. 27, 2015. PCT/GB2015/0509502 claims priority of GB 1411613.1 filed Jun. 30, 2014. The entire contents of these applications are incorporated herein by reference.

BACKGROUND OF THE INVENTION

The present invention concerns soundboard apparatus and a method of forming such apparatus, and particularly where such apparatus is made of composite materials.

Soundboards for pianos, harpsichords and similar instruments, are conventionally made of spruce wood. This material exhibits the favourable ratio of high stiffness to low density required to develop sound quality and sound power. Such properties are generally understood by piano designers to be those that best respond to the input of vibration energy from the strings of the piano.

However, spruce wood is subject to dimensional change with temperature and humidity. These climatic factors often lead to splitting of the soundboard and lack of tuning stability in adverse climates.

A responsive piano soundboard will have multiple natural frequencies that lie close to or at the frequency of the note being sounded. In the bass register of pianos the frequency interval (spacing) between such natural frequency modes, called eigen frequencies, is proportionally wider than in the upper registers. However the number and proximity of natural frequencies in the bass register can be greatly influenced by the thickness and hence stiffness of the sound board and to a lesser extent the stiffness of the bridge, board mounting and ribs. The thinner and more flexible the board the more eigen frequencies exist close to the note being sounded and the lower the lowest frequency (the first eigen mode) of these natural frequencies. Thus the bass response of a piano with a thin flexible rib-less soundboard is potentially better than that with a heavily ribbed and thick board. Further advantage can be gained by using different thicknesses in different zones of the board, a slightly thicker board in those regions of the piano soundboard responding to higher frequencies while using minimal thickness in those zones responding to bass frequencies can be beneficial. The position and shape of responding zones can be determined by finite element modal analysis of the soundboard under conditions of vibration energy input.

Pianos with thin and less robust and therefore less durable spruce wood soundboards that are less able to withstand loading from the strings have generally been found to have shorter quality life span and poorer tuning stability although their acoustic performance initially may be superior.

Various recently developed Carbon Fibre and Kevlar type composite materials incorporating carbon fibre, graphenes, fullerenes, and sundry glass fibres embedded in a matrix of resinous material offer significantly higher stiffness, strength and favourable ratio of stiffness to specific gravity. Piano designers have therefore attempted to apply some of these composites in piano sound board building. Generally this has been without a successful outcome because builders have been constrained to use too thick material for strength reasons in resisting the downwards pressure of the strings on the soundboard. Extra thickness has been found to favour undesirable high harmonics which are not usually acceptable to piano artists.

The strings of a grand piano are normally and principally held in firm contact with a bridge cap by a change of angle of the string in the vertical plane where it traverses the bridge. This creates a downwards contact load by the string on the bridge that, with adequate angular change, and string tension ensures the string when struck from below does not lose contact with the bridge cap. Loss of contact force results in a buzzing sound and inefficient vibration energy transfer to the sound board. This down bearing load is typically about 4 to 8 lbs (1.8 to 3.6 Kg) per string. As a consequence, a piano with about 230 strings will need a sound board stiff and strong enough to support a down bearing load of between 900 and 1 800 lbs (405-81 OKg). This defines the thickness and reinforcement means of the soundboard design needed to carry the down bearing load continuously throughout the many years of life of the instrument. A typical piano soundboard of adequate strength in spruce wood material is made of 4 to 9 mm thick wood planks butt joined and reinforced on its underside by rectangular often near square section spruce belly bars (ribs) typically about 25 mm in square cross section spaced about 1 00 mm apart.

To develop comparable stiffness and strength using, say carbon fibre would require a board material thickness of about 4 mm. Such large thickness in carbon fibre has been found to favour high frequency response and thus accentuation of undesirable upper harmonic sound. The applicants of the present invention have determined that the sound quality of a piano with such board is not generally acceptable.

Further it is well established that few if any spruce wooden boards last longer than 5 to 40 years in this duty before the sound power and quality of the instrument is lost as the board collapses under the continuous down bearing load, and sufficient contact force between string and bridge cap is reduced or completely lost. The thinner and thus weaker the board, the shorter the life of the instrument before this happens.

In the applicant's earlier patent disclosure No. WO 201 0 086690 A2, entitled "String-bridge interface system and method", there is described a means of developing contact force between string and bridge cap without resorting to a change of angle in the vertical plane of the string where it traverses the bridge cap and thus without generating a down bearing force.

SUMMARY OF THE INVENTION

The present invention takes advantage of this technology in developing an unusually thin fibre composite soundboard that alleviates unwanted harmonic problems associated with thicker soundboards.

In a first aspect of the present invention there is provided soundboard apparatus for a musical instrument, the apparatus comprising:—a soundboard substrate formed of composite fibrous resin bonded material having a thickness of between 0.75 mm and 3 mm; and an outer layer formed of ultra-violet light blocking material having a thickness of between 0.05 and 0.9 mm.

Carbon fibre in particular is dimensionally stable in a wide range of humidity, it is very resistant to splitting and dimensional change with temperature variation, thus making a more robust more durable and more tuning stable instrument possible. The combination of the substrate thickness and outer layer thickness provides soundboard apparatus with enhanced acoustic properties. The outer layer is preferably but not exclusively 0.6 to 0.8 mm thick wood veneer, and preferably substantially 0.7 mm thick.

Preferably, the outer layer is formed of one or more of wood material, paint, metal foil or metal deposition.

Conveniently, the outer layer is provided to one or both of an upper and an underside surface of the soundboard substrate.

The sound board apparatus may further comprise an integrated bridge unit of composite fibrous material, the fibres in the bridge being aligned in the direction of vibration energy transfer from string to soundboard. For grand pianos this is in the vertical plane. For upright pianos it is in the horizontal plane.

Preferably, but not exclusively, woven layers of fibre in a fibre composite substrate may comprise a weave of a double strand weft and a single strand warp to enable preferential energy transmission along a chosen dimension of the soundboard via the length of the majority of carbon fibres. These fibres are best as straight as possible.

Conveniently, but not exclusively, in the majority of layers, the double strand weft of the three strand woven layer or layers of the substrate is aligned along the major length dimension of the instrument soundboard substrate, and the single woven warp strand is aligned at right angles to the weft along the minor width dimension of the substrate. The straighter weft strands being stiffer and thus favourable to transmission of sound energy than the undulating warp strands. The length dimension being taken as broadly along the line of the long bridge of the piano which lies typically at an angle of about 50 degrees to the keyboard.

Preferably, the substrate is formed of a mathematically odd (uneven) number of layers of woven or unwoven strand fibre material, in each layer the fibre orientation being approximately orthogonal to its contiguous layer or layers. More particularly the substrate may be formed of either 3 or 5 layers of strand fibre material. The two outer layers being woven fibre material and the stiffer inner layers or layer being unidirectional unwoven fibre material.

Preferably and conveniently, the majority of the unidirectional unwoven fibres in the inner layers or layer of a substrate are orientated along the major length dimension of the soundboard in order to favour sound transmission velocity along the major length dimension of the instrument. Alternate layers being aligned approximately at right angles to one another Conveniently but not exclusively, the unwoven fibre inner strands of a substrate may have a greater fibre diameter than the woven fibres in the outer layers.

Preferably, the substrate of a 5 layer soundboard is formed with 2 outer layers of woven fibre composite material, having a three strand weave, and three inner layers of unwoven unidirectional straight fibre, the two outer of which are aligned along the major dimension of the substrate, the fibres of the single central layer being aligned along the minor dimension Preferably, the substrate of a 3 layer board is formed with 2 outer layers of woven fibre composite material and one inner layer of unwoven unidirectional fibre, the latter aligned along the major dimension of the instrument substrate.

According to a further aspect of the present invention there is provided a method of forming a soundboard apparatus as defined above, the method comprising the steps of:—bonding multiple layers of woven or straight stranded fibrous material in a resinous matrix to form a soundboard substrate, wherein the soundboard substrate is initially formed such that it is oversized in thickness with respect to required final soundboard substrate dimensions; and then dressing the soundboard substrate to finished thickness to form the final substrate, the dressing process, being constrained to ensure that in the final substrate the fibres in the inner layers are not cut by the dressing process.

Preferably, the dressing involves sanding and/or machining the multilayer soundboard substrate to make it smooth and flat.

Conveniently, the soundboard substrate is finished to achieve a flatness and thickness tolerance of not more than plus or minus 0.1 mm. During machining it is essential to avoid exposing or cutting fibres in the substrate inner layers and thus risking oxidation penetration or compromising shear adhesion of the fibres in the substrate matrix and consequent weakening of the material. It is preferable to design the substrate load capacity so that the woven outer layers function as sacrificial protective material and if weakened in dressing will ensure the inner layers are undamaged and able to carry the full load.

According to a further aspect of the present invention there is provided soundboard apparatus for a musical instrument, the apparatus comprising:—a soundboard substrate formed of composite fibrous resin bonded material having a thickness of between 0.75 mm and 3 mm, wherein the substrate is formed of at least 3 layers of woven or unwoven strand fibre material, wherein the majority of fibres in each layer of the substrate is orientated along the major length dimension of the soundboard, and wherein a central layer of the substrate has a greater fibre diameter than the other layers The present invention further encompasses a piano or similar percussion instrument incorporating soundboard apparatus as defined above.

BRIEF DESCRIPTION OF THE DRAWINGS

Examples of the present invention will now be described by way of example and with reference to the drawings, of which;—

DETAILED DESCRIPTION

Figure 1:
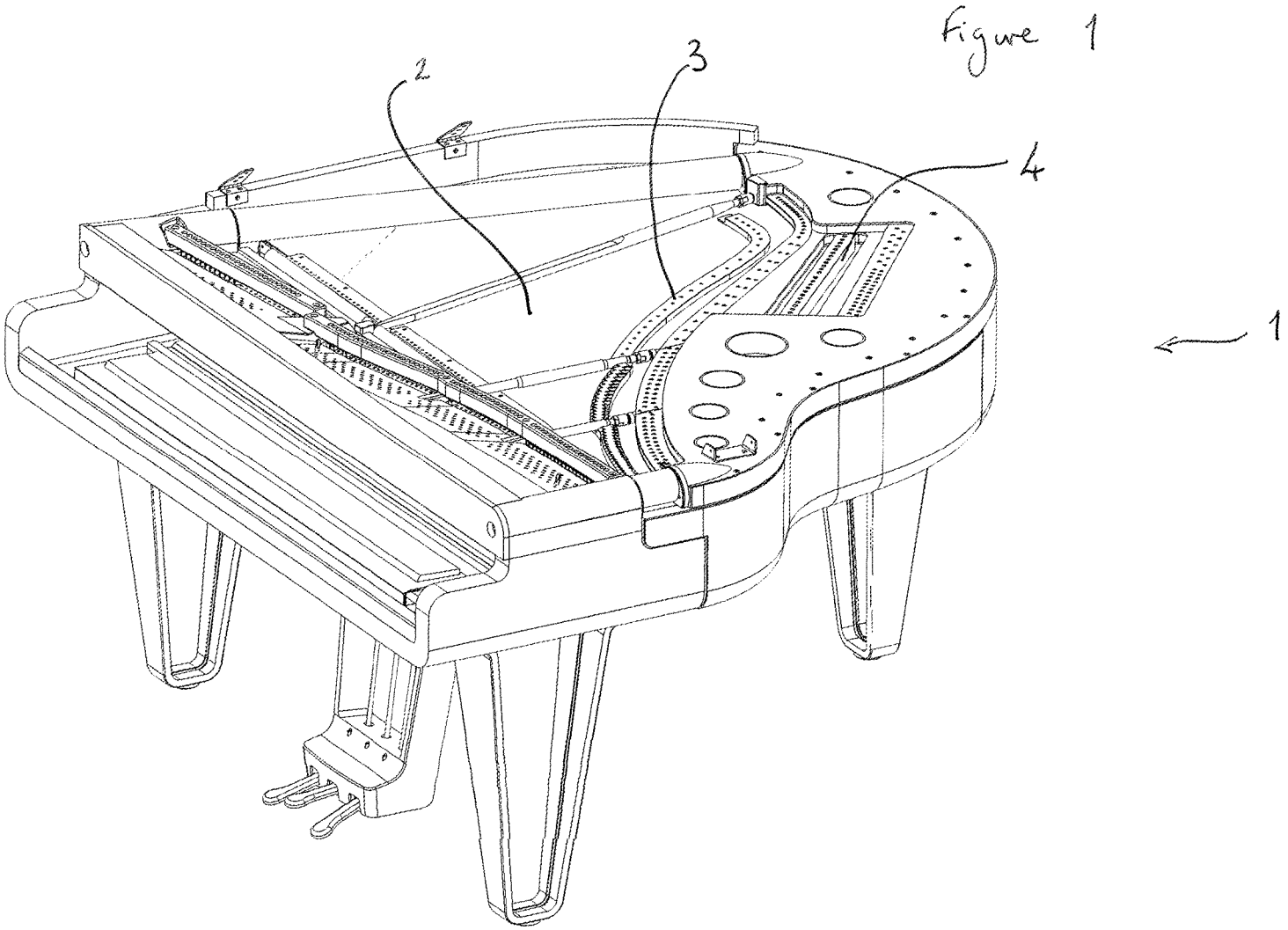
FIG. 1 shows a perspective view of a piano incorporating soundboard apparatus of the present invention.
Figure 2:
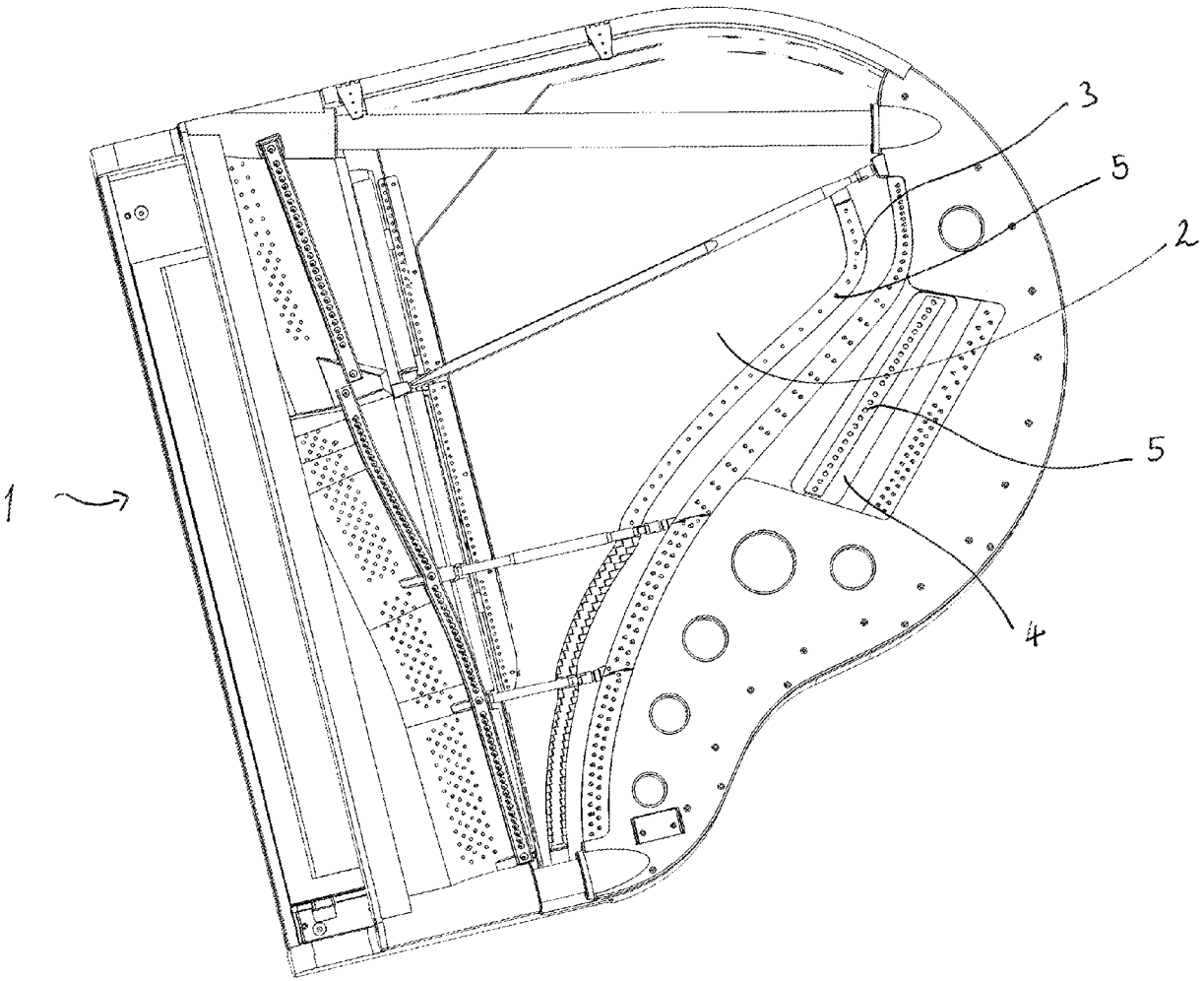
FIG. 2 shows plan view of the piano of FIG. 1.

The piano illustrated has two bridges. Other typical concepts of piano design may incorporate one, two or three bridges. As shown in FIGS. 1 and 2, a piano 1 has a soundboard 2 on which are provided two bridges, a long bridge 3 for transferring vibrational energy from the strings tuned to the treble and tenor notes to the soundboard and a bass bridge 4 for transferring vibrational energy from the strings tuned to the bass notes to the soundboard. On the upper surface of each bridge is provided a plurality of string bridge interfaces (agraffes) 5 is provided. The agraffes hold the strings firmly in contact with the upper surface of the bridges.

A desirable feature of all piano soundboards is that sound energy be distributed uniformly throughout the board at the same time. The velocity of sound in wood is greatest along the length of the wood grain. It is thus general practice to align the grain of spruce boards along the major dimension of the soundboard. Sound energy propagating across the board being substantially slower can be assisted by aligning the belly bars in the minor dimension direction. It is however probable that early instrument designers adopted this configuration with the objective of developing an integrated sheet of wood comprising planks held together by the ribs.

In this connection, the applicant has found that when manufacturing composite sheet materials for a soundboard containing fibrous materials, it is convenient to build up the sheet material with two outer layers of woven fibre and an odd number of inner layers of un woven unidirectional fibre. Fibre direction in each layer being orthoganol to the contiguous layer. The selection of different weaves, fibre gauge, number of layers of each weave and fibre orientation thus enable the designer to optimise the rate of distribution of vibration energy uniformly throughout the board with or without use of reinforcing belly bars which in traditional wood boards serve that purpose.

As stated above, the velocity and transmission of sound energy in a fibre composite sound board is highest along the length of straight fibres. The sound quality and harmonic content from such a soundboard as described above is similar to that of a conventional thickness spruce board but it is typically more powerful. Using the string bridge interface system disclosed in the applicant's earlier patent disclosure No. WO 2010 086690 A2, the downbearing load on the soundboard is alleviated and therefore relatively unstressed except by vibration, The soundbbard will not therefore progressively collapse under string load to the point at which adequate contact is lost between string and bridge cap which would result in poor sound and loss of efficiency of transfer of vibration energy into the soundboard from the string. For this reason the lifespan and durability of the instrument housing the described soundboard is greatly lengthened.

Composite sheet materials are typically manufactured by laying up several layers of resin impregnated fibre weave on a flat former plate and then curing this in a heated vacuum furnace. Whereas the under surface developed against the plate can be made reasonably flat and smooth, the upper surface (called the rough side) is not usually so smooth or accurate. Uncontrolled variation in thickness of the material of such a soundboard may lead to uncontrolled variability in sound quality across the registers of the piano. After forming and curing the board it is thus desirable to sand or machine both surfaces flat and to control the precise thickness of the board. However, post-forming work of any nature on composite fibre sheet materials may result in cutting of the fibres at the surface. Exposing the cut ends to atmospheric oxidation can severely weaken the material and result in deterioration of its strength with time. Under stress, the cut fibres at the surface may progressively detach from the resin matrix under shear forces. Oxidation can then more easily penetrate into and weaken the structure of the sheet.

The applicant has therefore established that by forming a soundboard substrate with a sacrificial woven layer on each side, it is possible to sand the board to the precise flatness and thickness required while the inner and undisturbed multiple layers or layer of fibre retain the required strength, acoustic properties and stiffness.

Typically but not exclusively, an odd number of layers of woven or unwoven strand fibre material are used with the majority of fibres in all layers being orientated along the major length dimension of the board in each layer. The inner unwoven unidirectional fibre layers may be typically but not exclusively of slightly greater fibre diameter.

The precise weave and orientation chosen is selected to distribute vibration energy as evenly in time as possible within the board. Preferably however, the sound board substrate outer layers have a three strand weave with a double strand (the weft) aligned along the major dimension (length) of the board and a single strand (the warp) aligned at right angles to the weft across the board in the second and fourth layer. The inner layers provide the strength and stiffness required while the two outer layers, are sacrificial material that can be dressed and thus reduced in thickness by sanding to achieve flatness and precision of thickness of the whole soundboard.

Recent development in carbon sheet forming, using a resin absorbing detachable cloth over the sheet while it is cured have enabled manufacture of soundboards of excellent thickness uniformity and flatness on both sides. Thin boards made by this method have been found to have sufficiently close tolerance on thickness that finish machining is not necessary.

Composite material and carbon fibre in particular is subject to degradation by ultra violet light. In manufacture of a soundboard we apply one or more layers of veneer wood or other UV light excluding material to the upper surface of the board which is the surface most likely to be exposed to ultra violet light. The applicant has determined that such veneer, if of the order of 0.7 mm thickness, has no undesirable influence on the acoustic properties of the board. Various paints metal foils and metal coating deposition and other surface treatments that reflect UV light can also be used for the same purpose.

Piano soundboards conventionally are fitted with one or more wooden bridges which transfer vibration energy from the strings to the soundboard. These bridges are normally made of beech and/or ebony and maple wood. The grain direction is typically predominantly vertical to optimise transfer of sound energy as efficiently as possible along the grain. Some manufacturers treat the wood to increase its hardness. Manufacture of a composite or carbon fibre bridge integral with the soundboard is facilitated if the soundboard itself is the same composite material. A carbon fibre bridge may be bonded to the upper surface of the soundboard. To ensure best acoustic energy transfer the thickness of the bond material must be minimal and less than 0.1 mm.

It follows that flatness of the sheet material and the under surface of the bridge in a bonded pair is critical in manufacture. Such bridge is advantageous for efficient transfer of vibration energy by virtue of the favourable low sound absorption characteristics of carbon or other fibre composites. A bridge made of these composites will be stiffer than a wooden bridge, and this could impart excess stiffness in the soundboard unless the bridge height of the composite material bridge is minimised. A typical wooden piano bridge is 30 to 35 mm height. A bridge of composite material would normally be 15 to 25 mm height.

The present invention can thus provide a piano or similar percussion instrument soundboard manufactured from composite fibrous resin bonded material of thickness from 0.75 mm to 3 mm built into the instrument with an agraffe (clip) system connection between the strings and the soundboard that does not impose significant downloading force on the soundboard.

Moreover, the piano or similar percussion instrument soundboard can comprise multiple layers of woven or straight stranded fibrous material bonded in a resinous matrix. The board can be manufactured on both sides to achieve flatness and thickness tolerance of not more than 0.2 mm. It will be appreciated that the contour thickness may vary in different zones of the board.

The flatness and thickness may be controlled by sanding or machining. The sanding or machining operation is preferably constrained in depth to ensure that the central or several inner layers of resin bonded fibres which are required to provide the necessary strength, acoustic properties, and thickness shall not be cut or damaged by the machining or sanding operation. The two or more outer layers thereby provide sacrificial material for adjustment of flatness and thickness. The sanding process is carried out using a precision belt sanding machine which removes the high spots leaving a flat smooth surface.

Further, the upper surface at least and optionally both surfaces of the soundboard may advantageously be covered by one or more veneered layers of wood material, paint or metal deposition to exclude ultra violet light which may otherwise degrade the composite material.

Additionally, an integrated or bonded bridge of similar material may be provided in which the fibres in the bridge section are principally aligned in the vertical plane.

The invention claimed is:

1. A soundboard apparatus for a musical instrument, comprising a soundboard substrate formed of composite fibrous resin bonded material having a thickness of between 0.75 mm and 3 mm; and an outer layer formed of ultra-violet light blocking material having a thickness of between 0.05 and 0.9 mm, said outer layer being formed of one or more of wood material, metal foil, paint, or metal deposition.

2. A soundboard apparatus according to claim 1, wherein the outer layer is provided to one or both of an upper and an underside surface of the soundboard substrate.

3. A soundboard apparatus according to claim 1, further comprising an integrated bridge of composite fibrous material.

4. A soundboard apparatus according to claim 1, wherein woven layers of fiber in the substrate comprise a weave of a double strand weft and a single strand warp.

5. A soundboard apparatus according to claim 4, wherein in a majority of layers, the double strand weft of a three strand woven layer or layers of the substrate is aligned along a major length dimension of the substrate, and the single woven warp strand is aligned at right angles to the weft along a minor width dimension of the substrate.

6. A soundboard apparatus according to claim 1, wherein the substrate is formed of a mathematically odd number of layers of woven or unwoven strand fiber material, in each layer the fiber orientation being substantially orthogonal to its contiguous layer or layers.

7. A soundboard apparatus according to claim 6, wherein the substrate is formed of three, five or seven layers of unwoven straight strand fiber material.

8. A soundboard apparatus according to claim 7, wherein two outer layers of the substrate are woven fiber material and inner layers or layer of the substrate are unidirectional unwoven fiber material.

9. A soundboard apparatus according to claim 8, wherein a majority of the unidirectional unwoven fibers in the inner layers or layer of the substrate are orientated along a major length dimension of the soundboard.

10. A soundboard apparatus according to claim 1, wherein the substrate of a five layer sound board is formed with two outer layers of woven fiber composite material, having a three strand weave, and three inner layers of unwoven unidirectional fiber, two of said inner layers being aligned along a major dimension of the substrate, the fibers of the central layer being aligned along a minor dimension.

11. A soundboard apparatus according to claim 1, wherein the substrate of a three layer sound board is formed with two outer layers of woven fiber composite material and one inner layer of unwoven unidirectional fiber, the latter layer being aligned along a major dimension of the instrument substrate.

12. A method of forming a soundboard apparatus as claimed in any preceding claim, the method comprising the steps of bonding multiple layers of woven or straight stranded fibrous material in a resinous matrix to form a soundboard substrate, wherein the soundboard substrate is formed such that it is oversized in thickness with respect to final soundboard substrate dimensions; and dressing the soundboard substrate to form the final substrate, the dressing process being constrained to ensure that in the final substrate, fibers in the inner layers of the final substrate are not cut by the dressing process.

13. A method according to claim 12, wherein the dressing involves sanding and/or machining the soundboard substrate.

14. A method according to claim 12, wherein the soundboard substrate is finished to achieve a flatness and thickness tolerance of not more than 0.2 mm.

15. A soundboard apparatus for a musical instrument, the apparatus comprising:— a soundboard substrate formed of composite fibrous resin bonded material having a thickness of between 0.75 mm and 3 mm, wherein the substrate is formed of at least three layers of woven or unwoven strand fiber material, wherein a majority of fibers in inner layers or layers of the substrate are orientated along a major length dimension of the soundboard.

16. A soundboard apparatus according to claim 15, wherein the substrate has five layers, and wherein a majority of fibers of a central layer of the substrate are aligned across a minor width dimension of the soundboard, with the majority of fibers in two inner layers adjacent the central layer being orientated along the major length dimension of the soundboard.

17. A soundboard apparatus according to claim 15, wherein the substrate has three layers, and wherein a majority of fibers of a central layer of the substrate are aligned along the major length dimension of the soundboard.

18. A piano or similar percussion instrument incorporating a soundboard apparatus according to claim 1.

* * * * *